US010464709B2

(12) United States Patent
Weyrauch et al.

(10) Patent No.: US 10,464,709 B2
(45) Date of Patent: Nov. 5, 2019

(54) PALLET CONTAINER

(71) Applicant: MAUSER-WERKE GMBH, Bruehl (DE)

(72) Inventors: Detlev Weyrauch, Kreuzau-Untermaubach (DE); Lukas Wahmes, Cologne (DE)

(73) Assignee: MAUSER-WERKE GMBH, Bruehl (DE)

( * ) Notice: Subject to any disclaimer, the term of this patent is extended or adjusted under 35 U.S.C. 154(b) by 0 days.

(21) Appl. No.: 16/066,324

(22) PCT Filed: Jan. 3, 2017

(86) PCT No.: PCT/EP2017/000002
§ 371 (c)(1),
(2) Date: Jun. 27, 2018

(87) PCT Pub. No.: WO2017/118599
PCT Pub. Date: Jul. 13, 2017

(65) Prior Publication Data

US 2019/0016503 A1 Jan. 17, 2019

(30) Foreign Application Priority Data

Jan. 7, 2016 (DE) ..... 20 2016 000 053 U

(51) Int. Cl.
*B65D 19/40* (2006.01)
*B65D 77/04* (2006.01)
*B65D 19/18* (2006.01)

(52) U.S. Cl.
CPC ..... *B65D 19/40* (2013.01); *B65D 19/18* (2013.01); *B65D 77/0466* (2013.01);
(Continued)

(58) Field of Classification Search
CPC .... B65D 19/40; B65D 19/18; B65D 77/0466; B65D 2519/00024; B65D 2519/00044;
(Continued)

(56) References Cited

U.S. PATENT DOCUMENTS 5,667,065 A * 9/1997 Fahrion ..... B65D 19/004 108/53.1
RE35,875 E * 8/1998 Shuert ..... 108/55.1
(Continued)

FOREIGN PATENT DOCUMENTS

DE 19642119 A1 3/1998
DE 10161693 A1 7/2003
(Continued)

OTHER PUBLICATIONS

International Search Report and Written Opinion for International Application No. PCT/EP2017/000002, dated Feb. 22, 2017.

*Primary Examiner* — Jose V Chen
(74) *Attorney, Agent, or Firm* — Marshall, Gerstein & Borun LLP

(57) ABSTRACT

A pallet container for storing and transporting liquid contents includes a rigid thin-walled inner container made of thermoplastic, a tube grid frame tightly surrounding the plastic inner container as a supporting jacket, and a base pallet, on which the plastic container rests and to which the tube grid frame is securely connected. The base pallet includes an upper support plate of steel sheet, upper support pipes parallel and diagonally directly under the support plate, corner feet, central feet, and a base pipe assembly of steel pipes. The assembly circulating below the corner and central feet. At least one central foot has an outer central foot part and an inner central foot part fixed between the upper support pipes and the base-side circulating base pipe assembly in the final assembled state. Both central foot parts
(Continued)

loosely engage into each other in a plugged formfitting manner.

10 Claims, 4 Drawing Sheets

(52) U.S. Cl.
CPC ..... *B65D 2519/00024* (2013.01); *B65D 2519/00044* (2013.01); *B65D 2519/00069* (2013.01); *B65D 2519/00208* (2013.01); *B65D 2519/00243* (2013.01); *B65D 2519/00273* (2013.01); *B65D 2519/00343* (2013.01); *B65D 2519/00567* (2013.01)

(58) Field of Classification Search
CPC ..... B65D 2519/00069; B65D 2519/00209; B65D 2519/00243; B65D 2519/00273; B65D 2519/00343; B65D 2519/00567
USPC ..... 108/55.1, 55.3, 57.31; 206/386
See application file for complete search history.

(56) References Cited

U.S. PATENT DOCUMENTS 6,463,863 B1 * 10/2002 Ishikawa ..... B65D 19/385 108/53.1
6,602,032 B2 * 8/2003 Arai ..... B65D 19/385 108/55.1
6,644,220 B2 * 11/2003 Gangloff ..... B65D 19/004 108/24
6,668,735 B2 * 12/2003 Cassina ..... B65D 19/004 108/55.1
8,256,615 B2 * 9/2012 Goda ..... B65D 19/06 108/55.1
8,418,632 B2 * 4/2013 Linares ..... B65D 19/0018 108/51.3
8,925,470 B2 * 1/2015 Hart ..... F16M 3/00 108/55.1
9,708,097 B2 * 7/2017 Banik ..... B65D 11/26
2002/0096445 A1 * 7/2002 Austin ..... B65D 19/38 206/386
2002/0185042 A1 * 12/2002 Sukeva ..... B65D 11/1873 108/55.1
2005/0115473 A1 * 6/2005 Schutz ..... B65D 19/10 108/55.1
2008/0143514 A1 * 6/2008 Valentinsson ..... B65D 19/0014 340/539.1
2008/0257230 A1 * 10/2008 Cassina ..... B65D 19/10 108/55.1
2008/0295748 A1 * 12/2008 Yoshida ..... B65D 19/0026 108/55.1
2009/0241809 A1 * 10/2009 Head ..... B65D 19/08 108/55.1
2010/0116178 A1 * 5/2010 Harris ..... B65D 19/385 108/53.3
2010/0175596 A1 * 7/2010 Scheetz ..... B65D 19/385 108/55.1
2011/0132239 A1 * 6/2011 Poulsen ..... B65D 19/0095 108/55.1
2011/0210027 A1 * 9/2011 Decroix ..... B65D 19/40 206/386
2013/0048522 A1 * 2/2013 Lorenz ..... B65D 19/18 206/386
2013/0276677 A1 * 10/2013 Kokatsu ..... B65D 19/0004 108/55.5
2014/0196634 A1 * 7/2014 Mansson ..... B65D 19/44 108/55.1

FOREIGN PATENT DOCUMENTS

DE 202004003020 U1 4/2004
EP 0673846 A1 9/1995
EP 2520504 A1 11/2012
KR 20030069918 A 8/2003
WO WO-2014044372 A1 3/2014
WO WO-2014044375 A1 3/2014

* cited by examiner

PALLET CONTAINER

CROSS-REFERENCE TO RELATED APPLICATIONS

This is the United States national phase of International Patent Application No. PCT/EP2017/000002, filed Jan. 3, 2017, which claims the priority benefit of German Application No. 20 2016 000 053.6 filed on Jan. 7, 2016. The entire contents of each of the foregoing are incorporated herein by reference.

FIELD OF DISCLOSURE

The invention relates to a pallet container for storing and for transporting in particular flammable or combustible liquid contents, having a thin-walled rigid inner container made of thermoplastic material for accommodating the liquid contents, having a tubular lattice frame which, in the form of a supporting casing, tightly encloses the inner plastic container and is made up of horizontal and vertical tubular bars which are welded to one another, and having a floor pallet, on which the plastic container rests and to which the tubular lattice frame is solidly connected, wherein possibly the inner plastic container is enclosed within the tubular lattice frame by a fire-protection insulating mat, and wherein the floor pallet is designed in the form of a composite pallet with an upper carrying panel made of sheet steel, with a carrying-tube linkage made of parallel and diagonally running tubes arranged directly beneath the carrying panel, with corner feet and midfeet, and with a floor-tube linkage or base-ring tube structure which is made of steel tubing and runs all the way round beneath the corner feet and midfeet.

BACKGROUND

Such a pallet container of the type in question with a lozenge-shaped carrying frame is described in detail, in the form of a development by Mauser-Werke GmbH, in WO 2014/044372 A1 (with electric discharge) and in WO 2014/044375 A1 (with mounting of the sheet-steel panel). Reference is made to both publications in respect of the pallet design and the contents thereof should be incorporated here in full.

EP 0 673 846 (Prot) discloses a similar pallet container, in the case of which the floor pallet is designed in the form of a steel pallet, with an upper sheet-steel tray and a steel-tube carrying frame arranged therebeneath, and, for the purposes of supporting the upper sheet-metal tray, is provided with a crossmember running transversely directly therebeneath. The two outer ends of the crossmember are designed in the form of integrally formed midfeet, which are welded to the longitudinal tubes of the lower frame and are positioned on the two longitudinal sides of the floor pallet. Between the midfeet, the crossmember is designed in the form of a profiled stiffening plate and, for this purpose, is provided with longitudinal ribs and outer flanges. A narrow planar sheet-metal strip has basically no bending stiffness; the sheet-metal strip obtains this bending stiffness by having longitudinal ribs and angled flange peripheries formed in it. These indentations formed in the strips, however, have to have a certain height/depth of at least 10-30 mm in order to provide a sufficient bending stiffness. However, this then reduces the introduction height for the forks of a forklift truck, because it is only forklift trucks which can handle filled pallet containers weighing approximately 1000 kg or above. Pallet containers are usually always picked up from the front, and therefore the crossmember—as its name implies—always stands transversely in the way of the fork tines which are being introduced. The integrally formed midfeet are provided only with a simple structural shaping with thin side flanks, and therefore they were not sufficiently able to withstand the loading to which they were subjected by fork tines constantly striking against them, and they soon deformed accordingly. Therefore, EP 2 520 504 (Prot) proposed an improved midfoot for a steel pallet, the intention being for this midfoot to eliminate the abovedescribed disadvantages and to have a greater stability against laterally acting fork-tine forces. Production and shaping by deep-drawing a single-piece steel plate, however, are work-intensive and costly. A crossmember is also required. In addition, the rear midfoot on the side located opposite the removal nozzle is only insufficiently supported on two parallel tubes and the thin-walled floor tray and is therefore at risk, in particular when the forklift truck is setting down the pallet container, of tipping over and bending.

DE 101 61 693 A1 (Sch-Pro) discloses another pallet container with fire-protection properties on a steel pallet, in the case of which a fire-protection casing comprising sheet-metal panels is arranged between the inner container and lattice frame, as is additional fire and heat insulation, which also covers the top and bottom of the inner plastic container. In addition, for the discharge of electric charges, the inner plastic container is also enclosed by a lattice-like enclosure made of thin metal wire. This known pallet container with improved fire-protection properties should satisfy the fire-safety regulations in accordance with US standard NFPA 30 for the storage of flammable and combustible liquids, monitored by the Underwriters Laboratories (UL), and, in the event of fire, should protect the inner bottle against damage, or against the liquid contents escaping, for a duration of at least 20 minutes with assistance from a sprinkler system.

GENERAL DESCRIPTION

If use is made of pallet containers with composite pallets and plastic feet for UL IBCs, it may be the case that, in the event of a fire lasting for a relatively long period of time, with pronounced action of heat from the outside, it is precisely these plastic feet which begin to soften, as a result of which the stability of filled pallet containers is highly compromised and, if pallet containers are stacked one upon the other, such a stack can easily come crashing down. This particular problem, of course, does not arise in the case of pallets which are made purely of steel.

It is the object of the present invention to develop a pallet container of the type in question, in particular also one such with flame-retardant properties, such that existing prior-art disadvantages are overcome, and that a particular construction of the same provides for sufficient fire resistance along with enduring stability even in the case of increased thermal loading, for example under the direct action of fire. The overall intention here is also to achieve a reduction in cost as a result of inexpensive production of individual parts with simplified assembly of those individual parts.

The technical teaching proposed establishes a use of the composite pallet with inexpensive plastic corner feet for a UL IBC, wherein, in particular for filled UL-IBCs stacked one upon the other, the stability (stack-loading capability) is maintained and the UL-IBCs are prevented from crashing down. This is achieved in an effective manner in that at least one midfoot of the floor pallet comprises two separate sheet-steel parts, namely an outer midfoot part and an inner midfoot part, which are specifically formed by punching and bending such that, in the definitively installed state, they are fixed between the upper carrying tubes and the all-round floor-tube linkage, wherein the two midfoot parts, plugged together with a straightforward plug-in fit, interengage in a form-fitting manner. It is possible here for the midfoot parts to be designed in three different ways, namely: first of all, completely free of any direct fastening in relation to one another; secondly, locked in relation to one another and otherwise free of any direct solid connection (screw connection, welding); and thirdly, connected solidly to one another. Inexpensive production of the individual parts with simplified assembly of the components in the floor-pallet system is thereby made possible.

In a specific configuration of the invention, provision is made for the outer midfoot part, having a central smooth outer-wall part with obliquely rearwardly bent side-wall parts connected laterally thereto, having a narrow head-flange strip, which is bent rearward at rightangles and is connected to the outer-wall part and side-wall parts at the top, and having a floor-flange strip, which is bent rearward likewise at rightangles and is connected to the outer-wall part and side-wall parts at the bottom, overall has a box-like construction which is open at the rear. The outer midfoot part is produced, from an inexpensive sheet-steel part with a wall thickness of approximately 2 mm, using just straightforward punching and bending steps, and the only other step required is for drillholes or threaded holes to be made therein. There is no need for any work-intensive welding of individual parts, and the component is immediately ready for use and ready for installation.

Cost-effective rapid assembly is also made possible, in particular, in that, in the definitively installed state, the inner midfoot part is plugged, as it were in the form of an inner-side rear wall for closing the open-rear box-like construction of the outer midfoot part, into the rearwardly bent floor-flange strip of the outer midfoot part via a coordinated sheet-metal-nose/slot form-fitting connection, and is otherwise free of any direct solid connection (screw connection, welding) to another component of the floor pallet.

For straightforward and cost-effective assembly, it is also very advantageous for the upper narrow head-flange strip of the outer midfoot part to be connected in the upward direction, from beneath, to an angled rail or the lowermost base ring running horizontally all the way round the tubular lattice frame and for the lower floor-flange strip of the outer midfoot part to be incorporated between two diagonally running, downwardly bent upper carrying tubes and the all-round floor-tube linkage. A further cost-related advantage can be achieved if a less complex configuration of the midfoot, in the case of which the inner midfoot part is dispensed with, is fitted at a position which is typically not subjected to such pronounced loading, i.e. at a position which, taking stability and design into account, allows such a configuration.

In one configuration of the invention, provision is made such that, in the definitively installed state, the inner midfoot part, in the form of an inner-side rear wall of the box-like construction, forms a solid bearing means with support in the downward direction for the two parallel steel tubes, wherein the ends of the two parallel steel tubes are clamped beneath the head-flange strip of the outer midfoot part and are thus fixed without any further fastening. This design measure—like the following one—allows straightforward assembly of the smaller number of individual parts, wherein, in the definitively installed state, the inner midfoot part, in the form of an inner-side rear wall of the box-like construction, is bent twice on each of the two outer sides, and these twice-bent wall parts form a kind of wall chamber into which opens out a respective right-angled bent portion of the diagonally running steel tubes, said bent portion having its end side screwed against the floor-tube linkage, which runs all the way round at floor level.

The stability of the midfoot structure increases further in that, in the definitively installed state, the outer midfoot part is bent twice on each of the two outer sides of the box-like construction, and these angled wall parts likewise form a kind of wall chamber into which opens out a respective right-angled bent portion of the diagonally running carrying-frame steel tubes, said bent portion having its end side screwed, through a through-passage bore made in the rearwardly bent floor-flange strip, to the floor-tube linkage, which runs all the way round at floor level.

BRIEF DESCRIPTION OF THE DRAWINGS

The features of the present invention which are presented above make it possible to form a particular pallet container with flame-retardant properties ("UL-IBC"), even with a composite pallet with heat-sensitive plastic pallet feet, such that it withstands the action of flames from the outside at least for a duration of approximately 25 minutes. The measures according to the invention prevent the situation where, under the action of heat from fire and incipient softening of the thermoplastic material of the corner feet of the floor pallet, the pallet feet buckle on one side and two filled UL-IBCs stacked one upon the other then crash down.

The invention will be described, and explained, in more detail hereinbelow with reference to a preferred exemplary embodiment illustrated in the drawings, in which.

DETAILED DESCRIPTION

Figure 1:
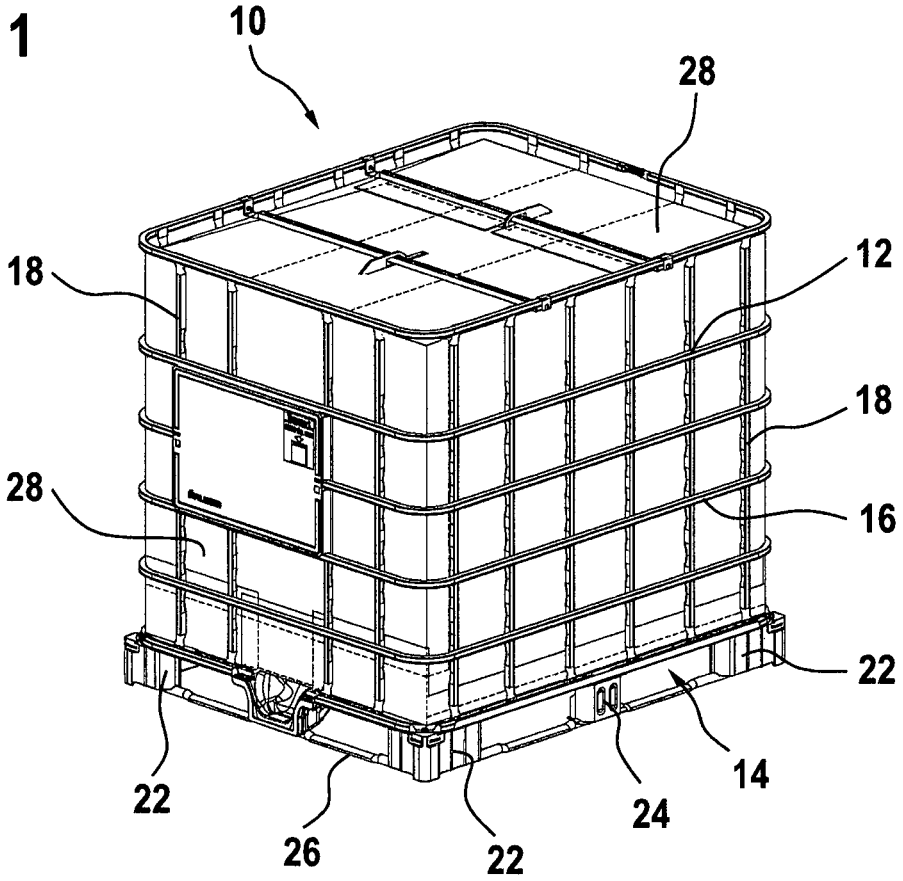
FIG. 1 shows a perspective view of a pallet container according to the invention with fire-protection properties on a composite pallet.

FIG. 1 uses the reference sign 10 to denote a pallet container according to the invention (UL-IBC) having a filling volume of 1000 l, having a thin-walled rigid inner container (not visible) made of thermoplastic material for the storage and the transportation of in particular hazardous flammable liquids, having a tubular lattice frame 12 which, in the form of a supporting casing, tightly encloses the inner plastic container, and having a floor pallet 14, on which the plastic container rests and to which the outer supporting casing is solidly connected. The tubular lattice frame 12 of the pallet container 10 comprises horizontal and vertical tubular bars 16, 18 which are welded to one another. In order to attain a closed outer container, the all-round horizontal tubular bars 16 are each connected in a solid and non-releasable manner to one another. In the present exemplary embodiment, the floor pallet 14 is designed in the form of a so-called composite pallet (sheet-steel panel on steel-tube frame with plastic feet), with an upper carrying panel 20 made of sheet steel for bearing the inner plastic container, with corner feet 22 produced by injection molding from thermoplastic material and with midfeet 24 produced from sheet steel. A floor-tube linkage 26 which is made of steel tubing and runs horizontally all the way round is fastened beneath the corner feet 22 and midfeet 24.

In the case of this pallet container 10, a fire-protection insulating mat 28 is arranged, in the form of a complete enclosure, directly between the tubular lattice frame 12 and the inner plastic container. It is also the case that the top and the bottom (for support on a pallet) of the inner plastic container are covered, and protected, by the fire-protection insulating mat 28. Appropriate, overlapping access flaps are made in the insulating mat 28 in order to provide access to the filling opening at the top and to the removal fitting at the bottom.

Figure 2:
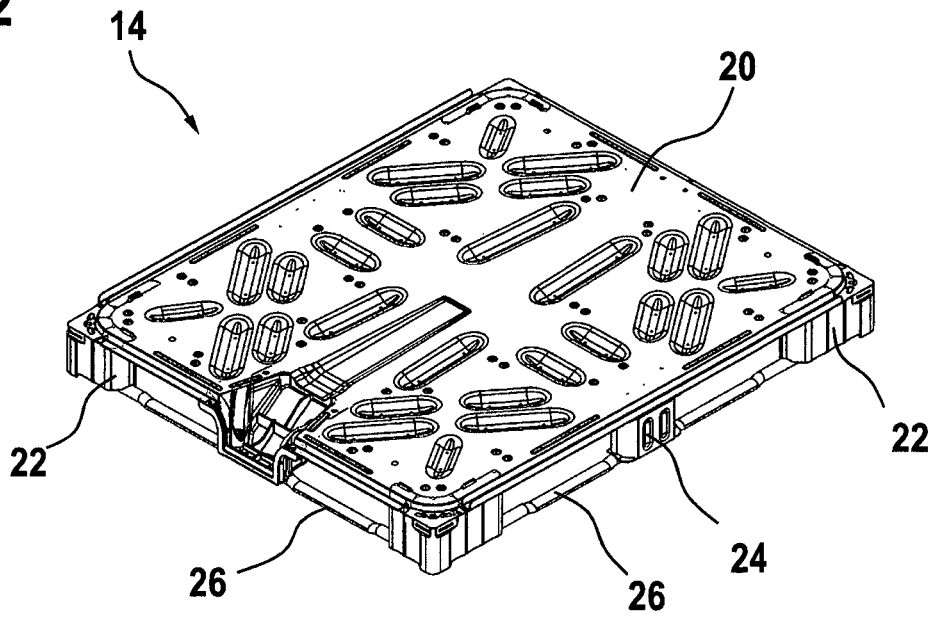
FIG. 2 shows a perspective view of the composite pallet according to FIG. 1.

In FIG. 2, the tubular lattice frame, the inner plastic container and the fire-protection insulating mat have been removed, and so this figure gives a perspective view solely of the composite pallet 14 of the pallet container 10 from FIG. 1. The upper carrying panel 20 made of thin sheet steel is provided with a multiplicity of beads for protecting the upper carrying tubes of the carrying-tube linkage arranged therebeneath. A particular shell-like midfoot made of plastic is arranged at the front, on a narrow side of the floor pallet 14. This shell-like midfoot is seated there directly beneath the removal fitting of the inner plastic container.

The corner feet 22, as mentioned, also consist of plastic, whereas the two lateral midfeet 24 and a rear midfoot 30 here are now produced from stable sheet steel. The floor-tube linkage 26, which is made of steel tubing and runs horizontally all the way round, is located beneath the corner feet 22 and midfeet 24, 30.

Figure 3:
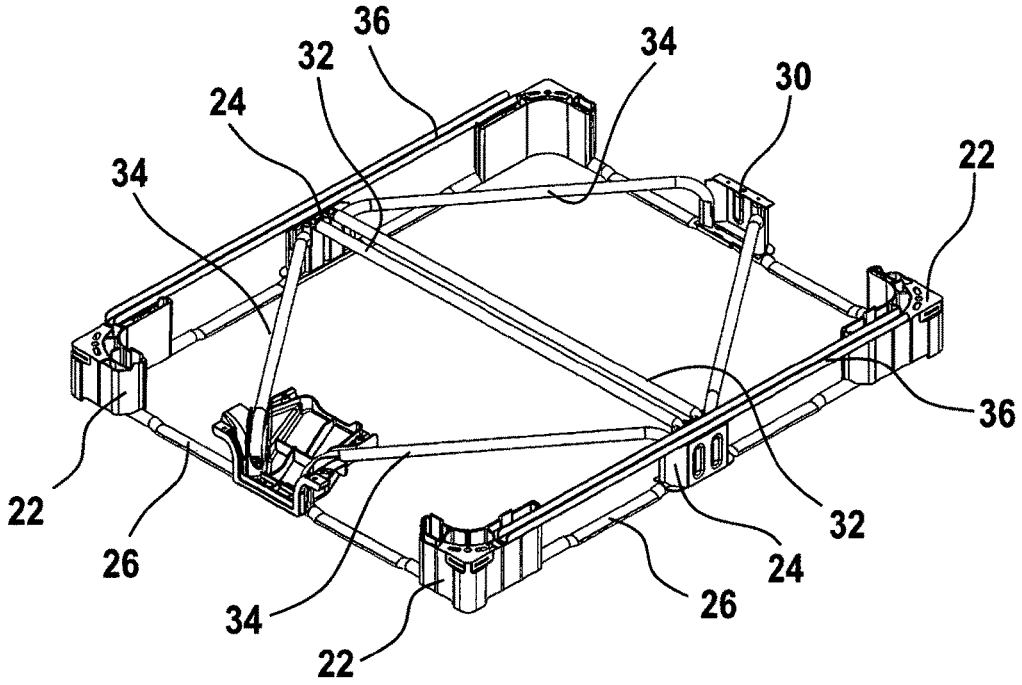
FIG. 3 shows a perspective view of the composite pallet according to FIG. 2 without a cover panel.

FIG. 3, in the same way, illustrates a perspective view of the composite pallet according to FIG. 2, albeit in this case also without the upper sheet-steel carrying panel 20. This is intended to show clearly the design of the substructure of the composite pallet. It is possible to see here, then, the upper carrying-tube linkage, which is seated directly beneath the carrying panel 20. The upper carrying-tube linkage comprises two rectilinear steel tubes 32, which run parallel to one another and close up one beside the other between the two lateral midfeet 24, and four steel tubes 34, which run diagonally between all four midfeet 24, 30 and, along with the sheet-steel carrying panel 20 and two angled rails 36 running along the longitudinal sides of the composite pallet, form the upper carrying frame of the floor pallet 14. The corner feet and midfeet form the spacing from the floor and create the space which is necessary for the engagement of the fork tines of a forklift truck. On the bottom side, the corner feet 22 and midfeet 24, 30, are fixed on the all-round floor-tube linkage 26 made of steel tubing in order to stabilize this composite pallet. The floor-tube linkage 26 is also referred to as a base-ring tube structure and, in the region of the corner feet and midfeet, has a circular cross section with a diameter of 20 mm. Between the corner feet and midfeet, where the fork tines of the forklift truck are intended to engage—from the front, from the rear or from the two opposite longitudinal sides of the floor pallet—the base-ring tube structure is of flattened design and, for the improved introduction of the fork tines, has a height of only approximately 15 mm (cf. FIG. 1).

Figure 4:
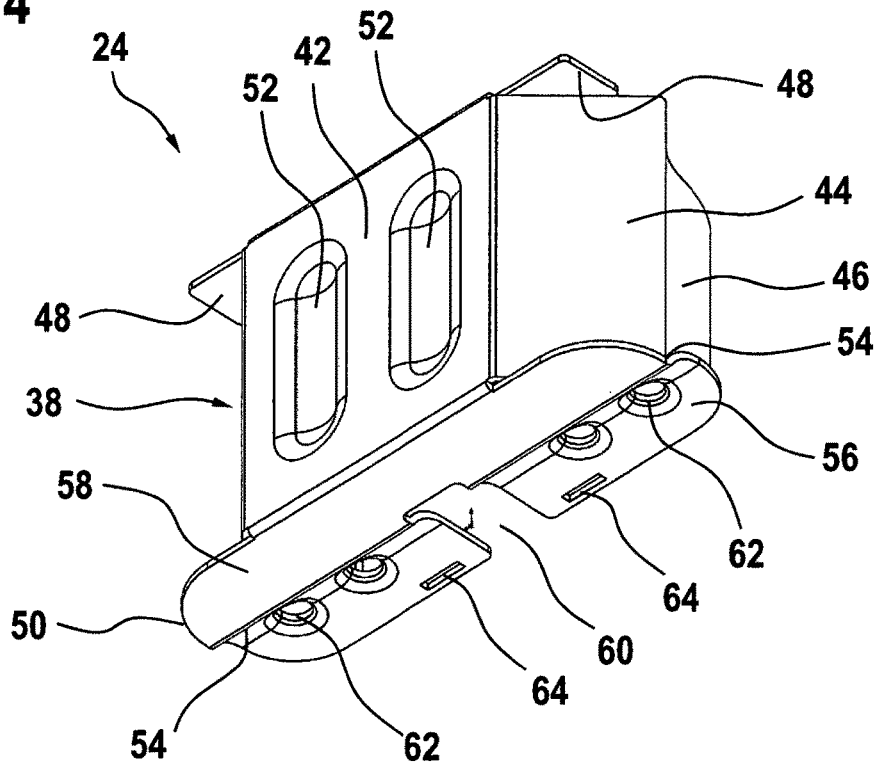
FIG. 4 shows a perspective view, as seen obliquely from beneath, of a sheet-steel midfoot (outer side)

FIG. 4 illustrates a perspective view of the specific shaping of a lateral midfoot 24. The midfoot 24 comprises two separate sheet-steel parts, namely an outer midfoot part 38 and an inner midfoot part 40, which are specifically formed by simple punching and bending such that, in the definitively installed state, merely loosely plugged together, they interengage in a form-fitting manner and are free of any direct fastening in relation to one another (plug-in fit). In addition, or as an alternative, to the plug-in fit in a purely form-fitting manner, it is also nevertheless possible for the midfoot parts to be locked in relation to one another and to be otherwise free of any direct solid connection (screw connection, welding) or also to be connected solidly to one another. In this view illustrated in FIG. 4, it is only the outer midfoot part 38 which can be seen. The outer midfoot part 38, having an outer smooth outer-wall part 42 with rearwardly bent planar side-wall parts 44 and adjoining side-wall endpieces 46 with rounded inward bending, having a narrow head-flange strip 48, which is bent rearward at rightangles and is connected to the outer-wall part at the top, and having a floor-flange strip 50, which is bent rearward likewise at rightangles and is connected to the outer-wall part at the bottom, overall has a box-like construction which is open at the rear. Two short parallel, vertically running stiffening beads 52 are stamped into the outer smooth outer-wall part 42. The planar side-wall parts 44, which adjoin the outer-wall part 42, are bent rearward at an angle of approximately 40° to 50°, preferably approximately 45°. These planar side-wall parts 44 are adjoined by the rounded, inwardly bent side-wall endpieces 46, which are shortened in height at the top. The upper head-flange strip 48, which is bent back rearward at rightangles, is designed to be comparatively narrow and rectangular, whereas the lower floor-flange strip 50 is designed to be at least double the width, with highly rounded corners. The floor-flange strip 50 is provided approximately centrally, and along its longitudinal direction, with a step-like shoulder 54 ("shoulder step"), and therefore the resulting rear half 56 is a few millimeters higher than the front half 58. An aperture 60, which is made during production, is provided in the center of the rear half 56 of the floor-flange strip 50. Two through-passage holes 62 are drilled or punched in on either side of said aperture. It is also the case that a short longitudinal slot 64 is punched into the inner periphery of the rear half 56 of the floor-flange strip 50 directly to either side of the central aperture 60. These longitudinal slots 64 serve for the form-fitting connection for the engaging sheet-metal noses of the inner midfoot part 40.

In contrast to the closed box-like midfeet which are known from the prior art, and in the case of which at least the side walls and, in some cases, also the rear walls are welded or soldered, with material bonding, at rightangles to the bottom and top along the outer edges, the embodiment according to the invention constitutes an "open" box-like component, in the case of which the bent-back side walls are joined in one piece, along a bending line (outer edge of the front wall), to the front wall and to the angled top (or head-flange strip) and the angled bottom (or floor-flange strip), said top and bottom only being bent rearward, so that the top and bottom can be supported against the side-wall parts arranged therebetween, without being fixed by means of a weld connection or the like. The upper and the lower end edges of the twice-bent-back side walls here, rather than butting against the outer edges of the top and bottom, are positioned within the horizontal surface area of the top and bottom, at a spacing therefrom, so that they cannot "slip off" or "slip out".

A look at the drawings shows that the side walls are therefore bent back rearward not along the lateral outer edges of the top and bottom, but a little distance before this, and therefore the corners of the outer edges of the top and bottom are located laterally outside the vertical lines along which the side walls are angled.

In contrast to known pallet structures in the case of which a solid crossmember (e.g. EP 0 673 846) is screwed firmly to the lateral midfeet, welded thereto or formed in one piece therewith, the embodiment according to the invention has its crossmembers, which are designed in the form of parallel tubes, merely plugged into the midfeet and clamped firmly between the outer part and inner part, wherein the parallel tubes are straightforward to produce and likewise straightforward to install during final assembly. Straightforward final assembly is also achieved by the midfeet having essentially their bottoms screwed firmly (cf. FIG. 8) between the right-angled bends of the diagonal carrying tubes of the upper carrying-tube linkage and the base-tube linkage, which runs all the way round at floor level. The tubular lattice frame 12 together with the angled rail 36, as a clamping element for the sheet-steel carrying panel 20, is screwed or riveted onto the head-flange strip 48 of the midfeet, wherein long insertion screws or rivet elements are dispensed with. Cost-effective production of the midfeet according to the invention is achieved not least by dispensing with a number of production steps such as multi-stage deep-drawing or work-intensive welding operations in favor of a straightforward plug-in fit.

Figure 5:
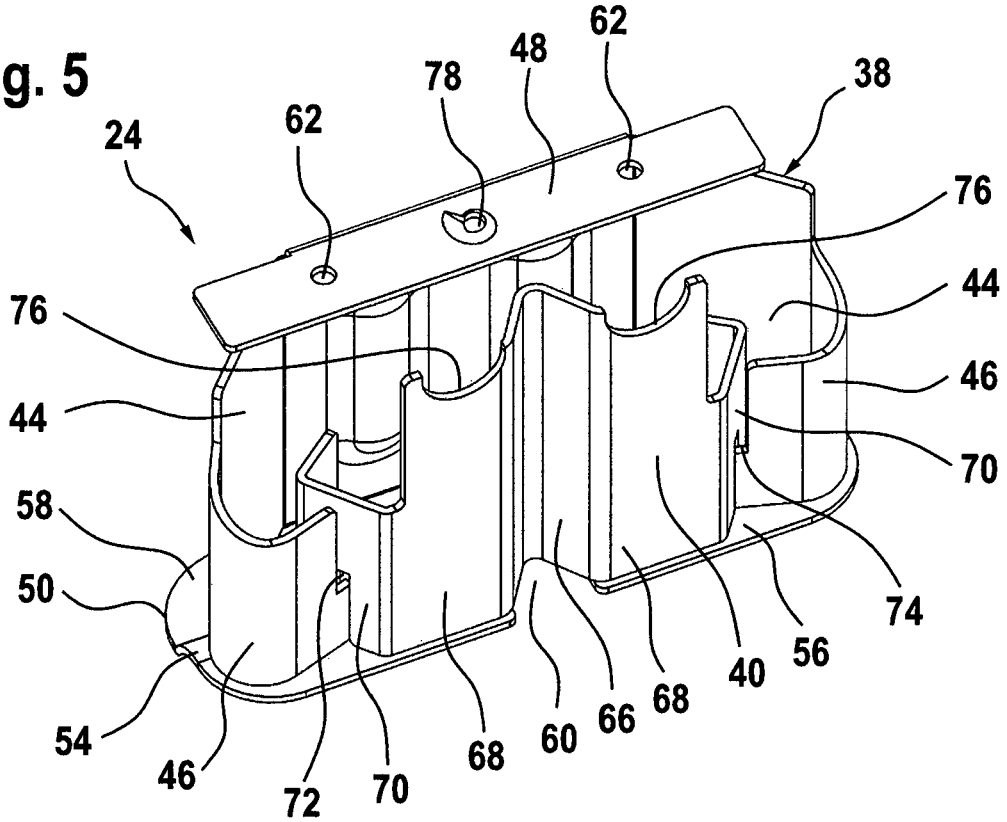
FIG. 5 shows a perspective view, as seen obliquely from above, of the sheet-steel midfoot (inner side) according to FIG. 4.

The perspective view of the lateral midfoot 24 in FIG. 5 also clearly shows the design and, in particular, the plug-in system of the outer midfoot part 38 along with the inner midfoot part 40. The inner midfoot part 40 has a centrally arranged stiffening bead 66 which is pressed inward in a V-shaped manner, runs vertically over the entire height and is adjoined on either side by two smooth main-wall parts 68. These two main-wall parts 68 are adjoined on the outer side in each case by shortened-height supporting-wall parts 70, which are angled or bent rearward in the first instance by approximately 40° to 50°, preferably approximately 45°, from the outer sides of the two main-wall parts 68, wherein in each case the rear halves of the two shortened supporting-wall parts 70 are then angled or bent rearward or inward once again by approximately 85° to 95°, preferably approximately 90°, and therefore these rear halves run almost parallel to the rearwardly bent planar side-wall parts 44 of the outer midfoot part 38. As an alternative to the abovedescribed angling at two locations, it is also possible for the supporting-wall parts 70 to be bent rearward or inward over a continuously rounded contour, wherein the rounding may be designed to be increasing or narrower towards the inner end, so that the rear parts of the two shortened supporting-wall parts 70 run almost parallel to the rearwardly bent planar side-wall parts 44 of the outer midfoot part 38.

An open slot 72 is made in the front halves of each of the two shortened supporting-wall parts 70, from the bottom to approximately halfway up said wall parts. In a manner corresponding to this, a respective short sheet-metal nose 74 of slightly lower height than the slot 72 is formed at the lower end of the rounded, inwardly bent side-wall endpieces 46 of the outer midfoot part 38 such that, when the inner midfoot part 40 is definitively installed or placed in position, said sheet-metal nose 74 engages in a precisely form-fitting manner in the slot 72 which is open from the bottom of the front halves of the two shortened supporting-wall parts 70 of the inner midfoot part 40.

It is also the case that the lower periphery of the two main-wall parts 68 of the inner midfoot part 40 has formed on it in each case similar sheet-metal noses which, when the inner midfoot part 40 is definitively installed or placed in position, engage in a precisely form-fitting manner in the downward direction in the short longitudinal slots 64 in the rear half 56 of the lower floor-flange strip 50 (this is not evident in this illustration of the drawing, cf. FIG. 4). To complete the lateral midfeet 24, all that is therefore required is for the inner midfoot part 40 to be inserted in a form-fitting manner from above, by way of the sheet-metal noses, into the corresponding slots in the outer midfoot part 38. There is no need for any further fastening in relation to one another; however, it is also possible for the midfoot parts to be locked in relation to one another and be otherwise free of any direct solid connection (screw connection, welding) or also to be connected solidly to one another. In a preferred embodiment, the midfoot parts, in the pre-assembled state, are free of any direct solid connection, and the fixing of the inner midfoot part 40 and of the outer midfoot part 38 of the lateral midfeet 24 takes place for the first time in a definitively installed state within the upper carrying tubes 32, 34 and the floor-tube linkage 26 of the floor pallet 14. It can also be seen, in this view of the drawing, that the upper narrow head-flange strip 48 is supported in each case on the upper periphery of the obliquely rearwardly bent-back planar side-wall parts 44 and in each case the lower periphery of the obliquely rearwardly bent-back planar side-wall parts 44 and the side-wall endpieces 46, which are connected thereto and have rounded inward bending, are supported on the lower floor-flange strip 50. The inner midfoot part 40, once placed in position, is supported only in the downward direction on the rear half 56 of the lower floor-flange strip 50, and is freely open in the upward direction. The side-wall parts 44 and/or the flange strips are therefore no more welded to one another than the inner midfoot part is to the outer midfoot part.

For the final assembly of the lateral midfoot parts 24 within the floor pallet 14, provision is made for the two planar main-wall parts 68 of the inner midfoot part to be provided, on their upper periphery in each case, with a semicircular hollow 76 (as support for the parallel steel tubes 32). The upper narrow head-flange strip 48, for the purpose of fixing the tubular lattice frame, has two through-passage holes 62 and a central prestole 78 in the form of a specifically designed threaded hole. The two through-passage holes 62 serve for fixing the angled rail 36 and could also be designed in the form of a prestole-type threaded hole.

Figure 6:
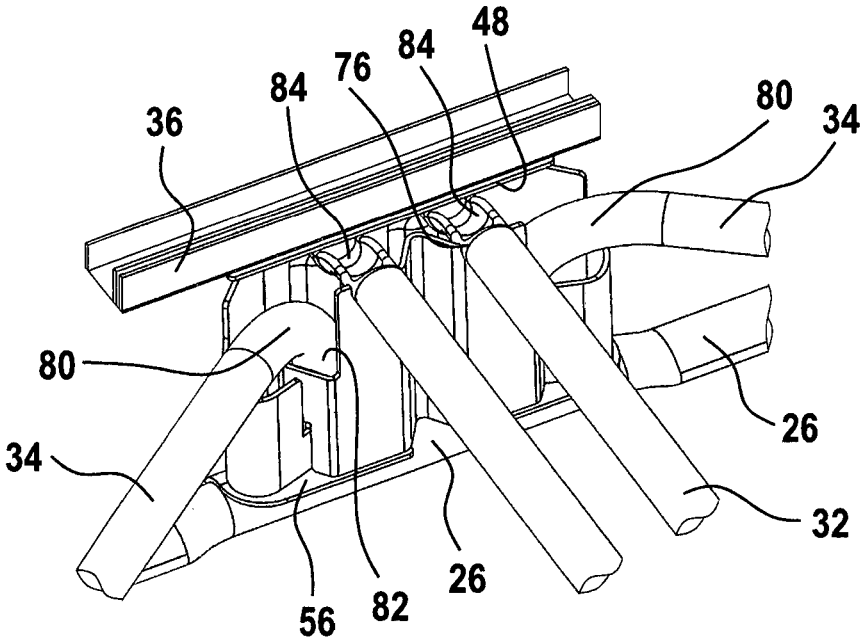
FIG. 6 shows a perspective view, as seen obliquely from above, of the sheet-steel midfoot (inner side) according to FIG. 5 in a state in which it is installed on the tubular lattice frame.

The definitively installed state of a lateral midfoot 24 within the floor pallet 14 is illustrated in a corresponding perspective view in FIG. 6, wherein, for better clarity, the sheet-steel carrying panel 20 and the tubular lattice frame 12 have been left out. The angled rail 36, then, is fastened on the upper narrow head-flange strip 48. The angled rail 36 has an upwardly open U profile and serves in the first place, along the two longitudinal sides of the floor pallet 14, for firmly clamping and fixing the twice-angled peripheries of the sheet-steel carrying panel 20, which is mounted on the lower pallet frame (cf. FIG. 3). The angled rail 36 is riveted solidly in the head-flange strip 48 through the two outer through-passage holes 62 or, if the through-passage holes 62 are also designed in the form of prestole-type threaded holes 78, is screwed directly therein and firmly clamps the angled peripheries of the sheet-steel carrying panel 20 beneath it.

Secondly, the upwardly open angled rail 36 serves for accommodating and fixing the lower tubular bar 16, which runs horizontally all the way round the tubular lattice frame 12. For this purpose, the central prestole 78 is provided in the form of a specifically designed threaded hole. The lower tubular bar 16, which runs horizontally all the way round the tubular lattice frame 12, is screwed therethrough to the head-flange strip 48 of the outer midfoot part 38, by means of a stable threaded screw, through the angled rail 36 and the angled periphery of the sheet-steel carrying panel 20. The rear half 56 of the floor-flange strip 50 of the outer midfoot part 38, said rear half being elevated somewhat as a result of the shoulder step 54, is seated on the floor-tube linkage 26 or base-ring tube structure, which runs all the way round at floor level.

The diagonal steel tubes 34 of the upper carrying-tube linkage of the floor pallet 14 are bent downward by 90° to form a bent portion 80 in each of their two end regions. These bent portions 80, with a length of approximately 90 mm, each engage from above in a wall chamber 82, which is formed from the two smooth main-wall parts 68 and the adjoining, shortened-height supporting-wall parts 70 angled rearward at two locations, and terminate, by way of their circular end surface, on the upper side of the somewhat elevated rear half 56 of the floor-flange strip 50. It is precisely at this location that one of the through-passage holes 62 is provided in each case in the rear half 56 of the floor-flange strip 50. Four-sided indentations or impressions of the tube wall are made over a small distance in the rectilinear ends of the bent portions 80 such that the internal tube diameter at these locations has been reduced from 17 mm to approximately 8 mm, and at the same time a thread has been formed or rolled in such that a kind of threaded sleeve nut (M8) is created there. For the same purpose, it would, of course, also readily be possible for a threaded nut to be pressed into the open end of the bent portions 80. By means of two countersunk screws, which are inserted from beneath through two recessed bores in the base-ring tube structure 26 and through the two inner through-passage holes 62 in the somewhat elevated rear half 56 of the floor-flange strip 50 of the outer midfoot part 38 and are screwed into the threaded sleeve nut of the two bent portions 80 of the diagonal steel tubes 34, the midfoot of the floor pallet 14 is clamped in firmly, and fixed, between the diagonal steel tubes 34 of the upper carrying-tube linkage, or the angled bent portions 80, and the floor-tube linkage 26, without the midfoot of the floor pallet 14 or the floor-flange strip 50 of the outer midfoot part 38 being itself screwed or welded directly to an adjacent part, as is otherwise customary in the case of known midfeet.

The inner midfoot part 40—as described above—is plugged in a form-fitting and captive manner, by means of two latching noses (sheet-metal noses) integrally formed on the lower periphery of the two planar main-wall parts 68, into two corresponding floor-side longitudinal slots 64 in the somewhat elevated rear half 56 of the floor-flange strip 50 of the outer midfoot part 38. There is also a corresponding plug-in connection between the open slot 72 in the two shortened supporting-wall parts 70 of the inner midfoot part 40 and the short sheet-metal nose 74, which is plugged into said slot and is located at the lower end of the rounded, inwardly bent side-wall endpieces 46 of the outer midfoot part 38. There is no need for any further direct fixing of the inner midfoot part 40 to the outer midfoot part 38; however, it is also possible for the midfoot parts to be locked in relation to one another and to be otherwise free of any direct solid connection (screw connection, welding) or else to be connected solidly to one another. For example, it is possible for the midfoot parts, in addition to the form-fitting plug-in connection, to be locked in relation to one another in that the latching noses integrally formed on the planar main-wall parts 68 are rotated slightly after being plugged into the longitudinal slots 64. This simple locking method provides for the cost-effective production of the midfeet in the form of a pre-assembled component for simplified cost-optimized final assembly of the pallet container.

In this definitively installed state, the inner midfoot part 40 is also fixed by the two bent portions 80 of the diagonal steel tubes 34, said bent portions engaging from above, opening out into the wall chamber 82 formed by the supporting-wall parts 70, which are angled rearward at two locations, and being screwed to the base-ring tube structure 26 through the rear half 56 of the floor-flange strip 50. Furthermore, the inner midfoot part 40 of the two midfeet 24, which are arranged along the longitudinal sides of the floor pallet 14, are fixed by the two parallel tubes 32. For this purpose, the two parallel tubes 32 have, at their two tube ends, a pressed-flat end region which is angled somewhat downward, i.e. is bent slightly downward. These angled tube ends 84, then, on the one hand, are supported in the downward direction in the hollow 76, each hollow being formed on the upper periphery of the two planar main-wall parts 68 of the inner midfoot part 40, and, on the other hand, are supported, by way of the upper side of the flattened end regions, against the underside of the head-flange part 48 of the outer midfoot part 38.

In a surprisingly straightforward construction, in the definitively installed state, the inner midfoot part 40 is plugged, as it were in the form of an inner-side rear wall for closing the open-rear box-like construction of the outer midfoot part 38, into the rearwardly bent floor-flange strip 50 of the outer midfoot part 38 via a coordinated peg/slot form-fitting connection and is otherwise preferably free of any direct solid connection (screw connection, welding) to another component of the floor pallet 14. The box-like midfoot 24—as seen from the outside—has a width of approximately 160 mm, a depth (in the inward direction) of approximately 52 mm and a height of approximately 100 mm. The sheet steel used here has a wall thickness of approximately 2 mm. The corner feet and midfeet of the floor pallet of a filled pallet container are usually subjected to very pronounced loading by the fork tines of a forklift truck. In the case of the newly designed outer midfoot part 38, it is, in particular, the rearwardly bent planar side-wall parts 44 and adjoining side-wall endpieces 46, with rounded inward bending, which are subjected to the most pronounced stressing by the fork tines. The stressed wall parts 44, 46 are supported in a stable manner as a result of a short sheet-metal nose 74 being arranged in each case at the outer end of the rounded, inwardly bent side-wall endpieces 46 of the outer midfoot part 38, said sheet-metal nose engaging in a form-fitting manner in the slot 72 which is open from the bottom of the front halves of the two shortened supporting-wall parts 70 of the inner midfoot part 40. In the definitively installed state, the outer ends of the inner midfoot part 40, which form the wall chamber 82, are as it were "wrapped around" the bent portions 80 of the diagonal steel tubes 34 engaging therein and, as a result of being supported thereon via the form-fitting slot/nose connection, provide additional hold for the stressed wall parts 44, 46 of the outer midfoot part 38.

Figure 7:
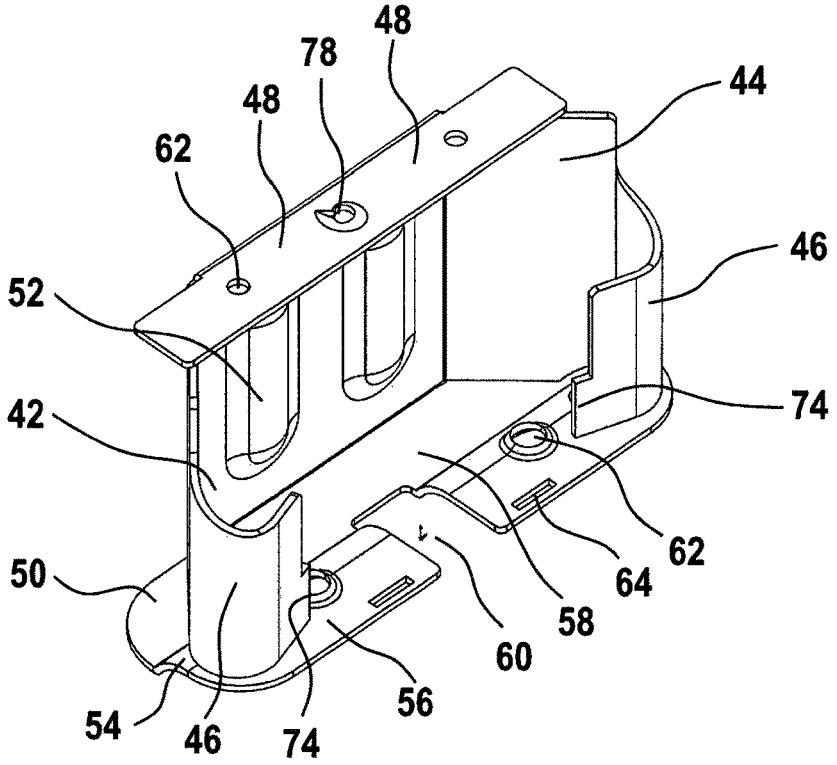
FIG. 7 shows a perspective view, as seen obliquely from above, of a further sheet-steel midfoot (inner side)

FIG. 7 illustrates a simplified embodiment of a midfoot. This simplified midfoot 30 is used on the relatively narrow, rear side of the pallet container (opposite the outflow fitting—cf. FIG. 3) since, rather than any parallel steel tubes, there are only two diagonally running steel tubes 34 opening out and mounted here. Since there are no parallel steel tubes provided here, the inner midfoot part 40 is also done away with or dispensed with here altogether. In a constructive embodiment (A4), the upper narrow head-flange strip 48 is connected in the upward direction, from beneath, to the C profile or the lowermost tubular bar running horizontally all the way round the tubular lattice frame 12 and the lower floor-flange strip 50 of the outer midfoot part 38 is connected to the two diagonally running upper carrying tubes 34 and the all-round floor-tube linkage 26.

Figure 8:
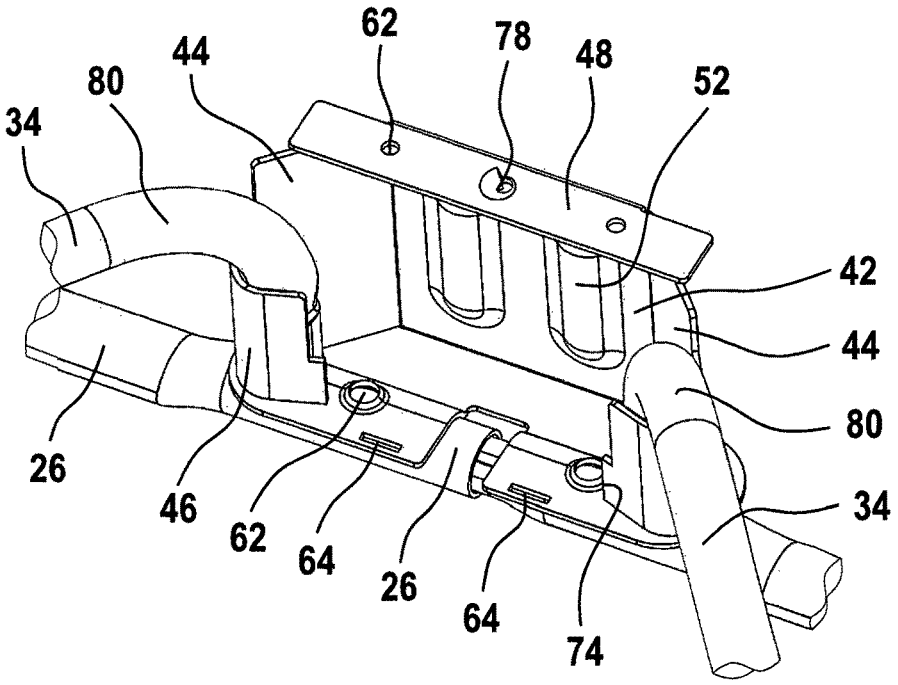
FIG. 8 shows a perspective view, as seen obliquely from above, of the further sheet-steel midfoot (inner side) in a state in which it is installed in the tubular lattice frame.

The partial illustration in FIG. 8 shows in detail form (the sheet-steel carrying panel, the angled rail and the tubular lattice frame being left out) the two diagonal tubes 34 being supported, via their end-side bent portions 80, on the rear half 56 of the lower floor-flange strip 50. The bent portions 80—as described above—are clinched at the end to form a threaded sleeve nut and are screwed firmly into the sleeve nut, and fixed, by means of a countersunk fillister-head or flat-head screw inserted from beneath through the floor-tube linkage 26 and the lower floor-flange strip 50.

As far as a composite pallet with plastic feet is concerned, the present solution according to the invention has the advantageous secondary effect that it is possible to dispense with any additional electrical-discharge device for the usually non-conductive plastic feet. In the case of UL-IBCs and the use of the same for combustible or explosive liquid contents, the required approval regulation stipulates a device or measure for discharging electric charges into the underlying surface as being mandatory. The midfeet made of sheet steel are screwed, on the one hand, in the upward direction to the sheet-steel angled rail 36 (and the tubular lattice frame 12) running outer periphery of the upper sheet-steel carrying panel 20 and, on the other hand, to the floor-tube linkage 26, which runs all the way round at the bottom. This ensures that the conductive blow-molded component (inner plastic container) is grounded, via a conductive inner layer, to the outside of the fabric of the fire-protection insulating mat and thus to the lattice cage and/or the floor panel. Even if two filled pallet containers are stacked one above the other, however, it is also ensured that electric charges are discharged from the upper container into the ground. The upper pallet container has the outer-side or front halves 58 of the floor-flange strips 50 of the midfeet and corner feet standing on the uppermost all-round horizontal tubular bar 16 of the tubular lattice frame 12 of the lower pallet container, wherein the floor-tube linkage 26 which runs all the way round the bottom of the upper pallet container, and is fastened beneath the rear halves 56 of the floor-flange strips 50 of the midfeet, butts from the inside against the uppermost all-round horizontal tubular bar 16 of the tubular lattice frame 12 of the lower pallet container, and engages some way from above into the tubular lattice frame 12 of the lower pallet container, and thus prevents the upper pallet container from slipping laterally. The metallic contact between the floor-tube linkage and tubular lattice frame always provides for a reliable discharge of electric charges.

CONCLUSION

It is clear from the above description and the figures how the existing disadvantages of the prior art can be easily eliminated by the technical teaching of the present invention and a component which is straightforward to produce and install is disclosed to a person skilled in the art in the form of a midfoot for a composite pallet.

The invention claimed is:

1. A pallet container for storing and for transporting in particular flammable or combustible liquid contents, having a thin-walled rigid inner container made of thermoplastic material, having a tubular lattice frame which, in the form of a supporting casing, tightly encloses the inner plastic container and is made up of horizontal and vertical tubular bars which are welded to one another, wherein the inner plastic container is possibly enclosed by a fire-protection insulating mat, and having a floor pallet, on which the plastic container rests and to which the tubular lattice frame is solidly connected, wherein the floor pallet is of composite design with an upper carrying panel made of sheet steel, with upper carrying tubes running parallel and diagonally directly beneath the carrying panel, with corner feet and midfeet, and with a floor-tube linkage which is made of steel tubing and runs all the way round beneath the corner feet and midfeet, at least one midfoot comprises two separate sheet-steel parts, namely an outer midfoot part and an inner midfoot part, which are specifically formed by punching and bending such that, in a definitively installed state, they are fixed between the upper carrying tubes and the all-round floor-tube linkage, wherein the two midfoot parts, plugged together with a plug-in fit, interengage in a form-fitting manner.

2. The pallet container as claimed in claim 1, the outer midfoot part, having a central smooth outer-wall part with obliquely rearwardly bent side-wall parts each connected laterally thereto, having a narrow head-flange strip, which is bent rearward at right angles and is connected to the outer-wall part and side-wall parts at the top, and having a floor-flange strip, which is bent rearward likewise at right angles and is connected to the outer-wall part and side-wall parts at the bottom, overall has a box-like construction which is open at a rear portion thereof.

3. The pallet container as claimed in claim 2, in the definitively installed state, the outer midfoot part is bent twice on each outer side of the box-like construction, and these bent wall parts form a kind of wall chamber into which opens out a respective right-angled bent portion of the upper carrying tubes running diagonally, said bent portion having its end side screwed, through a through-passage bore made in the floor-flange strip, to the floor-tube linkage, which runs all the way round at floor level.

4. The pallet container as claimed in claim 2, wherein the narrow head-flange strip of the outer midfoot part is connected in an upward direction, from beneath, to an angled rail or a lowermost base ring running horizontally all the way round the tubular lattice frame and, with the inner midfoot part being dispensed with, the lower floor-flange strip of the outer midfoot part is connected to the two upper carrying tubes running diagonally and the all-round floor-tube linkage via the right-angled bent portions.

5. The pallet container as claimed in claim 1, the two midfoot parts, which are plugged together with a plug-in fit and interengage in a form-fitting manner, are plugged together loosely and are free of any direct fastening in relation to one another.

6. The pallet container as claimed in claim 1, the two midfoot parts, which are plugged together with a plug-in fit and interengage in a form-fitting manner, are provided with a locking means for the plug-in fit and, beyond that, are free of any direct fastening in relation to one another.

7. The pallet container as claimed in claim 2, in the definitively installed state, the inner midfoot part is plugged, as it were in the form of an inner-side rear wall for closing the box-like construction of the outer midfoot part, into the floor-flange strip of the outer midfoot part via at least one coordinated peg/slot form-fitting connection, and is otherwise free of any direct solid connection to another component of the floor pallet.

8. The pallet container as claimed in claim 1, in the definitively installed state, the inner midfoot part, in the form of an inner-side rear wall of the box-like construction, forms a solid bearing means with support in the downward direction for the upper carrying tubes running in parallel, wherein the ends of the upper carrying tubes running in parallel are clamped beneath the head-flange strip of the outer midfoot part and are thus fixed without any further fastening.

9. The pallet container as claimed in claim 1, in the definitively installed state, the inner midfoot part, in the form of an inner-side rear wall of the box-like construction, is bent twice on each outer side, and these bent wall parts form a kind of wall chamber into which opens out a respective right-angled bent portion of the upper carrying tubes running diagonally, said bent portion having its end side screwed against the floor-tube linkage, which runs all the way round at floor level.

10. The pallet container as claimed in claim 1, in the definitively installed state, the inner midfoot part, in the form of an inner side rear wall of the box-like construction, is bent in the form of a continuously rounded contour on each of the two outer sides, and these bent wall parts form a kind of wall chamber into which opens out a respective right-angled bent portion of the upper carrying tubes running diagonally, said bent portion having its end side screwed against the floor-tube linkage, which runs all the way round at floor level.

* * * * *